US005477033A

United States Patent [19]

Bergholtz

[11] Patent Number: 5,477,033

[45] Date of Patent: Dec. 19, 1995

[54] ENCAPSULATED WATER IMPERVIOUS ELECTRICAL HEATING PAD

[75] Inventor: Peter Bergholtz, Rockport, Mass.

[73] Assignee: Ken-Bar Inc., Reading, Mass.

[21] Appl. No.: 139,317

[22] Filed: Oct. 19, 1993

[51] Int. Cl.[6] ..... H05B 3/10

[52] U.S. Cl. ..... 219/549; 219/528

[58] Field of Search ..... 219/528, 529, 219/548, 549

[56] References Cited

U.S. PATENT DOCUMENTS 3,153,140 10/1964 Theordore ..... 219/549
3,168,617 2/1965 Richter ..... 219/549
3,268,846 8/1966 Morey ..... 219/549
4,717,812 1/1988 Makita ..... 219/528
4,860,434 8/1989 Louison ..... 219/548

*Primary Examiner*—Teresa J. Walberg
*Assistant Examiner*—Sam Paik
*Attorney, Agent, or Firm*—Bookstein & Kudirka

[57] ABSTRACT

An encapsulated water impervious electrical heating pad adapted for use in moist and rough handling conditions, as in a greenhouse environment includes an electrical resistance heating element sandwiched between a pair of sheets, the sheets having inner layers formed from a tacky pressure-sensitive adherent material and an outer protective layer of a water impervious polymer.

8 Claims, 1 Drawing Sheet

ENCAPSULATED WATER IMPERVIOUS ELECTRICAL HEATING PAD

FIELD OF THE INVENTION

The invention relates to water resistant heating pads and method for its manufacture.

BACKGROUND OF THE INVENTION

The invention relates to a heating pad adapted for use in an environment where the pad can be expected to be exposed to moisture and rough conditions or handling. For example, such heating pads are useful in a greenhouse as a bench pad to be placed under pots or other growing containers. Such greenhouse heating pads typically have incorporated a heating element embedded within a rubber or polymeric material, manufactured in a process that involves the application of heat in order to effect the desired bond and seal between the components of the heating pad. The use of heat and materials that require application of heat in the manufacturing process necessarily complicates the process and adds to the cost of manufacture. In addition to the relatively high cost of heat sealable polymeric materials and the energy to effect their seal, the heat developed during the sealing process may distort or otherwise effect the operating characteristics of the electrical resistance heating element which may have an operating temperature range less than that required to effect the heat sealing process.

It would be desirable to provide a water resistant heater pad having an embedded heating element that is capable of manufacture in a simple, low-cost process, yet which is durable and is adapted for rough use.

SUMMARY OF THE INVENTION

The heating pad employs a resistant heating element such as a thin wire or ribbon that is sandwiched between a pair of protective, encapsulated sheets having inwardly facing pressure-sensitive adhesive surfaces so that the sheets may adhere to each other and to the heater element. Each protective sheet includes an inner layer formed from a highly tacky, flexible waterproof material which, if punctured, will self-seal about the puncturing element or will self-seal the hole thus formed if the puncturing element is withdrawn. Each protective sheet also includes an outer layer of flexible, imperforate polymeric material to provide an externally exposed smooth, tough, water impervious surface. The heating pad is manufactured in a "cold" process in which the heating element is sandwiched between the pressure-sensitive self-sealing adhesive surfaces of the sheets. No heat is used during the pad manufacturing process. No solvents or additional adhesives are required.

It is among the general objects of the invention to provide an improved encapsulated electrical heating device.

Another object of the invention is to provide an improved electrical heating pad that is impervious to water and fully encapsulates and protects the internal heating element from the environment.

A further object of the invention is to provide an improved heating pad adapted for use in the greenhouse environment.

Also among the objects of the invention is to provide an improved, simplified process for manufacturing such pads.

DESCRIPTION OF THE DRAWINGS

The foregoing and other objects and advantages of the invention will be appreciated more fully from the following further description thereof, with reference to the accompanying drawings wherein.

DESCRIPTION OF THE PREFERRED EMBODIMENTS

Figure 1:
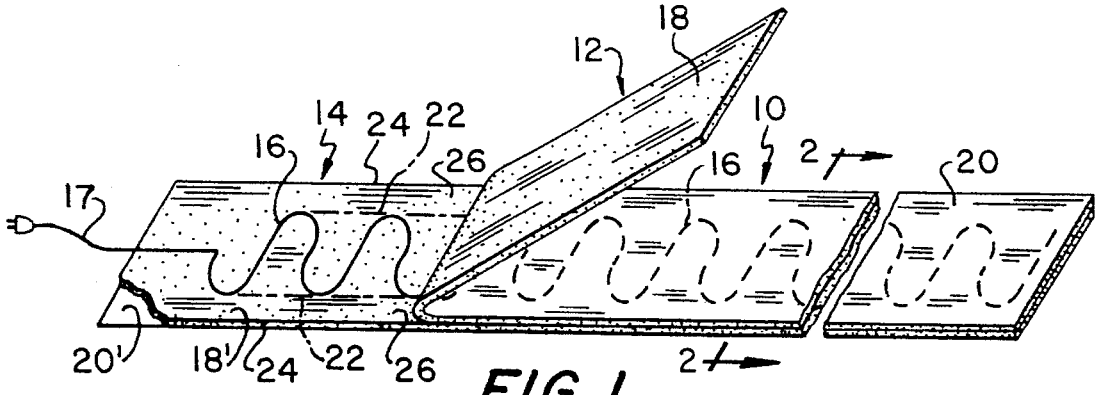
FIG. 1 is a fragmented illustration of one embodiment of the invention.
Figure 2:
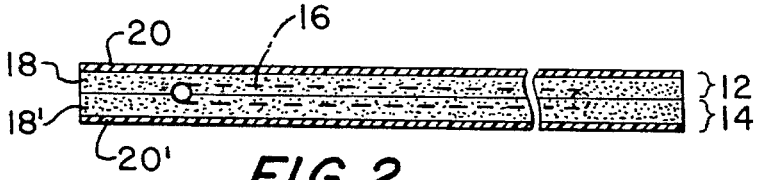
FIG. 2 is an enlarged cross-sectional illustration of the heating pad as seen along the line 2—2 of FIG. 1.

FIG. 1 is a fragmented plan illustration of one embodiment of the invention, partly peeled apart to illustrate the internal structure of the device. The heater pad, indicated generally at 10 includes a pair of sheets 12, 14 and an electrical resistance heating element 16 sandwiched between the sheets 12, 14. The sheets 12, 14 and the heating element 16 are flexible and can be rolled into a more compact configuration, for example, for storage or shipping. By way of example, in a heater adapted for use in a greenhouse, a pad may be made in a strip configuration, up to about three feet wide and about thirty feet long, it being understood, of course, that the principles of the invention may be incorporated into heater pads having other dimensions adapted for other specific uses. The heating element 16 may be any of a variety of commercially available heating elements and may be formed, for example, from nickel-chromium wire, carbon based electrically resistive formulations, etched foil, resistive ink or other flat self-contained heating elements of the type commercially available from the Flexwatt Corporation of West Wareham, Mass. and Flexi Heat of Canada. A The heating element 16 may be arranged in a wide variety of configurations, the serpentine configuration illustrated in FIG. 1 being merely illustrative. The heating element 16 includes a connective wire 17 that extends out of the heating pad for connection to a source of electricity.

Each of the sheets 12 includes at least two layers including an inner adhesive layer 18 and an outer protective layer 20. The inner layer is formed from a tacky compound having adhesive properties by which it may adhere to other materials and to itself solely under the influence of pressure. The material also is impervious to water and is self-sealing when punctured by another member. The material should effect a seal about the puncturing element or, if the puncturing element is withdrawn, it should form a seal at the puncture site. By way of example, a suitable material may be in the form of rubberized asphalt, that is, asphalt mixed with a polymeric adhesive such as styrene-butadiene-styrene (SBS). The inner adhesive layer 18 may be, by way of example, of the order of 0.040 inches thick. The outer layer 20, which may be approximately one-quarter of the thickness of the inner layer (e.g., about 0.010 inches thickness) is formed from a sheet of flexible, water impervious polymeric material such as, for example, polyethylene. Sheets having both a suitable tacky adhesive inner layer 18 and an outer polymeric layer 20 may be obtained commercially under the trade name Bituthane from the W. R. Grace Company or from Northern Elasomeric of N.H. The Bituthane material typically is used in building construction to provide a water impervious membrane. It should be noted that although polyethylene has been found suitable, other materials may be employed for the outer layer 20.

The heating element 16 is arranged so that its lateral boundaries, indicated in phantom at 22 are well within the lateral edges 24 of the sheets 12, 14, thereby leaving a margin 26 along each of the lateral edges of the heater pad. The highly tacky pressure-sensitive inner layers 18 contact each other directly along the margins thereby forming a secure waterproof seal fully about the edges of the composite device. By way of example, in the dimensional example discussed above, the lateral margins may be of the order of ½ to 1 inches wide with a similar width margin at the ends of the pad.

The heating element is connectible to an electrical source through a power cord 17. The power cord is connected to the heating element 16 and traverses the margins to emerge from the pad. The region of the margin at which the power cord 17 emerges may, additionally, be filled with curable silicone sealant in order to assure a water-tight seal.

The device is easily manufactured without the need to apply heat in order to effect sealing and bonding. The manufacture of the device involves simply placing the heating element 16 on the tacky inner layer 18 of one of the sheets and then applying the other sheet with its inner layer 18 facing and against the inner layer of the first sheet. The heating element 16 thus is sandwiched between the two layers. The highly tacky pressure sensitive adhesive inner layers 18 bond securely to each other about the margin as well as to the heating element itself.

Figure 3:
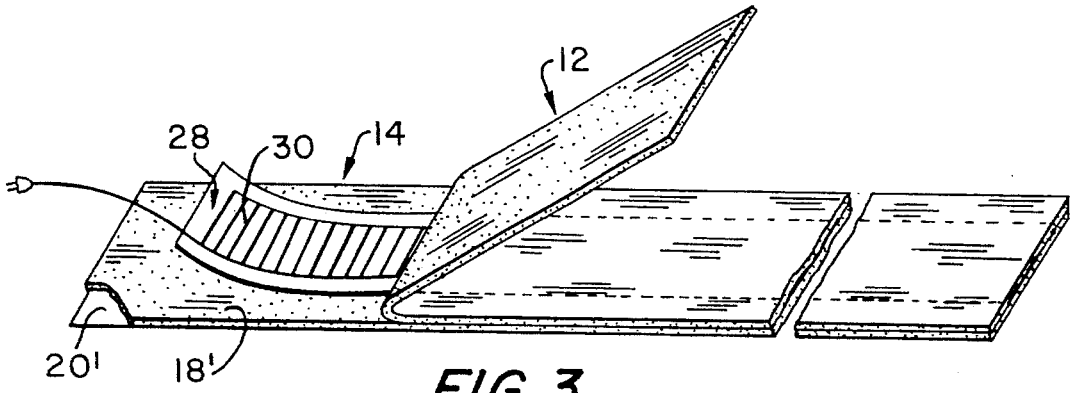
FIG. 3 is a fragmented illustration of another embodiment of the invention incorporating another type of resistance heating element.

FIG. 3 illustrates another embodiment in which the heating element is in the form of a preformed sheet 28 of plastic material having the heating resistance elements incorporated into the sheet. Resistance heaters of this type are commercially available from Flexwatt Corporation. By way of example, such heaters are disclosed in U.S. Pat. No. 4,656,339, the disclosure of which is hereby incorporated by reference in its entirety issued to Flexwatt Corporation. In this embodiment, the preformed plastic sheet 28 with integral heating element 30 is interposed between a pair of sheets 12, 14 in the manner described above. The sandwich then is pressed together firmly to effect the seal about the margins and to the heater as described above.

Thus, it will be appreciated that the invention provides a simple and effective way to make a flexible heating pad suited particularly for use in environments where the pad can be expected to be subjected to moisture and rough handling. The pad is easy to manufacture, being made in a "cold" process in which heat does not have to be applied in order to effect a seal or a bond of the various components of the device. The device is flexible and presents a tough outer protective skin to the environment. It is adapted particularly for use in a greenhouse or other growing environment.

It should be understood, however, that the foregoing description of the invention is intended merely to be illustrative thereof and that other modifications, embodiments and equivalents may be apparent to those skilled in the art without departing from its spirit.

Having thus described the invention what I desire to claim and secure by Letters Patent is:

1. A flexible, water impervious heating pad comprising:

an electrical resistance heating element;

a pair of sheets disposed on opposite sides of the heating element and sandwiching the heating element between the sheets, each of the sheets comprising an inner layer formed from a pressure sensitive adhesive hydrophobic material and an outer protective flexible water impervious layer;

the sheets being bonded to the heating element and to each other;

the sheets extending about the heating element to form a sealed margin substantially fully about the heating element;

the adhesive being flowable to facilitate self-sealing of a puncture through the pad.

2. A heating pad as defined in claim 1 wherein the inner layer comprises rubberized asphalt.

3. A heating pad as defined in claim 2 wherein the protective outer layer comprises a polymeric sheet having a thickness less than the inner layer.

4. A method for making a water resistant heating pad comprising:

providing a pair of sheets, each sheet having an inner layer formed from a pressure sensitive adhesive hydrophobic material and an outer protective flexible polymeric sheet, the adhesive material being flowable to facilitate self-sealing of a puncture through the pad;

applying a heater element to the inner layer of one of the sheets;

applying the inner layer of the other of the sheets against the inner layer of the first sheet and the heating element;

pressing the two sheets and heater element together without applying heat sufficiently to assure complete waterproof encapsulation of the heating element within the heating pad.

5. A method as defined in claim 4 wherein the adhesive layer comprises rubberized asphalt.

6. A method as defined in claim 5 wherein the sheets are polymeric and have a thickness less than the adhesive layer.

7. A flexible, water impervious heating pad comprising;

an electrical resistance element:

a pair of sheets disposed on opposite sides of the heating element and sandwiching the heating element between the sheets, each of the sheets having an outer protective flexible water impervious layer;

an inner layer of pressure sensitive adhesive hydrophobic material disposed between the sheets and bonding the sheets to each other to encapsulate the heating element between the sheets the adhesive being flowable to facilitate self-sealing of a puncture through the pad;

the sheets extending about the heating element to form a sealed margin substantially fully about the heating element.

8. A method for making a water resistant heating pad comprising:

providing a pair of sheets, each having an outer protective flexible polymeric layer;

disposing a heating element between the sheets;

providing an inner layer, formed from a pressure sensitive adhesive hydrophobic material between the outer sheets, the adhesive material being flowable to facilitate sealing of a puncture through the pad;

pressing the two sheets and heater element together to effect a sandwich of the sheets, inner layer and pressure sensitive adhesive hydrophobic material without applying heat, sufficiently to assure complete waterproof encapsulation of the heating element within the heating pad.

* * * * *